United States Patent [19]

Ishimoto et al.

[11] Patent Number: 4,617,002

[45] Date of Patent: Oct. 14, 1986

[54] WIRELESS CONTROLLABLE CAR WITH A WINCH MECHANISM

[75] Inventors: Zenichi Ishimoto; Tadashi Konno, both of Tokyo, Japan

[73] Assignee: Nikko Co., Ltd., Tokyo, Japan

[21] Appl. No.: 800,375

[22] Filed: Nov. 22, 1985

Related U.S. Application Data

[63] Continuation of Ser. No. 657,874, Oct. 4, 1984, abandoned.

[30] Foreign Application Priority Data

Apr. 13, 1984 [JP] Japan ..... 59-53454[U]

[51] Int. Cl.[4] ..... A63H 17/14; A63H 30/04

[52] U.S. Cl. ..... 446/427; 446/456

[58] Field of Search ..... 446/427, 424, 456, 454, 446/455, 428, 443; 242/84.2 B, 221

[56] References Cited

U.S. PATENT DOCUMENTS

| | | | |
|---|---|---|---|
| 2,896,876 | 7/1959 | Bogar | 242/84.2 B X |
| 3,772,825 | 11/1973 | Gagnon | 446/454 X |
| 4,213,270 | 7/1980 | Oda | 446/456 |
| 4,216,612 | 8/1980 | Erickson et al. | 446/427 X |
| 4,479,327 | 10/1984 | Wakimura | 446/427 |

*Primary Examiner*—Mickey Yu

*Attorney, Agent, or Firm*—Young & Thompson

[57] ABSTRACT

A wireless-controllable toy car with a winch mechanism is disclosed which is provided, in addition to driving wheels and the winch mechanism, with an electric motor for driving and controlling the wheels, another electric motor for controlling the winch mechanism, and a change-over switch for switching a power circuit for the electric motors.

1 Claim, 4 Drawing Figures

WIRELESS CONTROLLABLE CAR WITH A WINCH MECHANISM

This application is a continuation of application Ser. No. 657,874 filed Oct. 4, 1984, abandoned.

FIELD OF THE INVENTION

This invention relates to a toy car, especially a wireless-controllable toy car, with a winch mechanism.

BACKGROUND OF THE INVENTION

In the art of the wireless-controllable toy car, there has been needed a conveniently operable mechanism, which is similar to and mimics that of the existing cars.

From such point of view, there has been proposed a toy car with a winch mechanism of a simple construction, in which a winch drum is rotated simply by an electric motor for automatically winding and unwinding a winch rope. The wireless-controllable toy car with the winch mechanism, however, should be controlled for its running operation separately from the winching operation. For this purpose, a conventional wireless transmitter may be utilized if gear-transmission is carried out for a single driving source.

In such type of toy cars, however, arrangement of a gear-transmission at a portion of a reduction gear connected to an electric motor as a driving source may not only make the mechanism more complicated but also cause wear and damage of the gear due to its prolonged use, leading to disorder or malfunction. Furthermore, upon operation of the winch mechanism, discontinuation of the rotation of the winch drum at the end of the winding operation may cause strain on the electric motor which if continued, may result in a dangerous burnout of the motor. To solve these problems, an idling mechanism may be provided at a joint between the electric motor and the gear for avoiding unusual overload of the electric motor. In this case, however, a normal load is always applied to the electric motor during the running operation. Thus, operation of the idling mechanism in the overload state may considerably reduce the running performance.

Accordingly, such type of toy car should be desirably provided with a convenient but trouble-free means for switching the running and the winching operations, as well as a means for preventing the overload of the electric motor which may be operated only upon controlling the winch.

An object of the invention is to provide a wireless-controllable toy car with a winch mechanism, in which running and winching operations may be separately and independently conducted by individual electric motors, an energizing circuit for which may be electrically switched-over, and in which the winch at its motor side is provided with a means for preventing overload, resulting in a simple and trouble-free construction of excellent operability.

SUMMARY OF THE INVENTION

In order to achieve the above object, the invention provides a wireless-controllable toy car with a winch mechanism, which comprises, in addition to driving wheels and the winch mechanism, an electric motor for driving and controlling the wheels, another electric motor for controlling the winch mechanism, and a change-over switch for switching a power circuit for said electric motors.

In other words, in accordance with the invention, the separate operation through the individual electric motors may achieve a convenient switching operation through an electrical switching means without any gear-transmission mechanism.

In accordance with the invention, the electric motors for the wheels and the winch mechanism are operable for their normal or reverse rotation and discontinuation through a common wireless-controllable transmitter.

Furthermore, in accordance with the invention, the electric motor for the winch mechanism at its output shaft may be connected through a reduction gear to a winch drum, at a joint between said output shaft and said reduction gear being provided an idling means for preventing overload of the electric motor upon discontinued operation of the winch drum at the end of the winding cycle of the winch mechanism.

In such case, according to the invention, the idling means comprises preferably a gear on the output shaft of the electric motor, and a pair of fixed rings for holding therebetween said gear through a spring having an axially resilient action.

Still further, in accordance with the invention, for coupling the winch drum with the reduction gear, the winch drum is preferably supported on a shaft of the reduction gear while an oppositely mounted reduction gear and an opposite face of the winch drum are preferably provided with meshing elements engageable with each other in the rotating direction, said shaft being supported through another spring having an axially resilient action.

The invention will be described in more detail as to its preferred embodiments with reference to the accompanying drawings.

PREFERRED EMBODIMENT OF THE INVENTION

Figure 1:
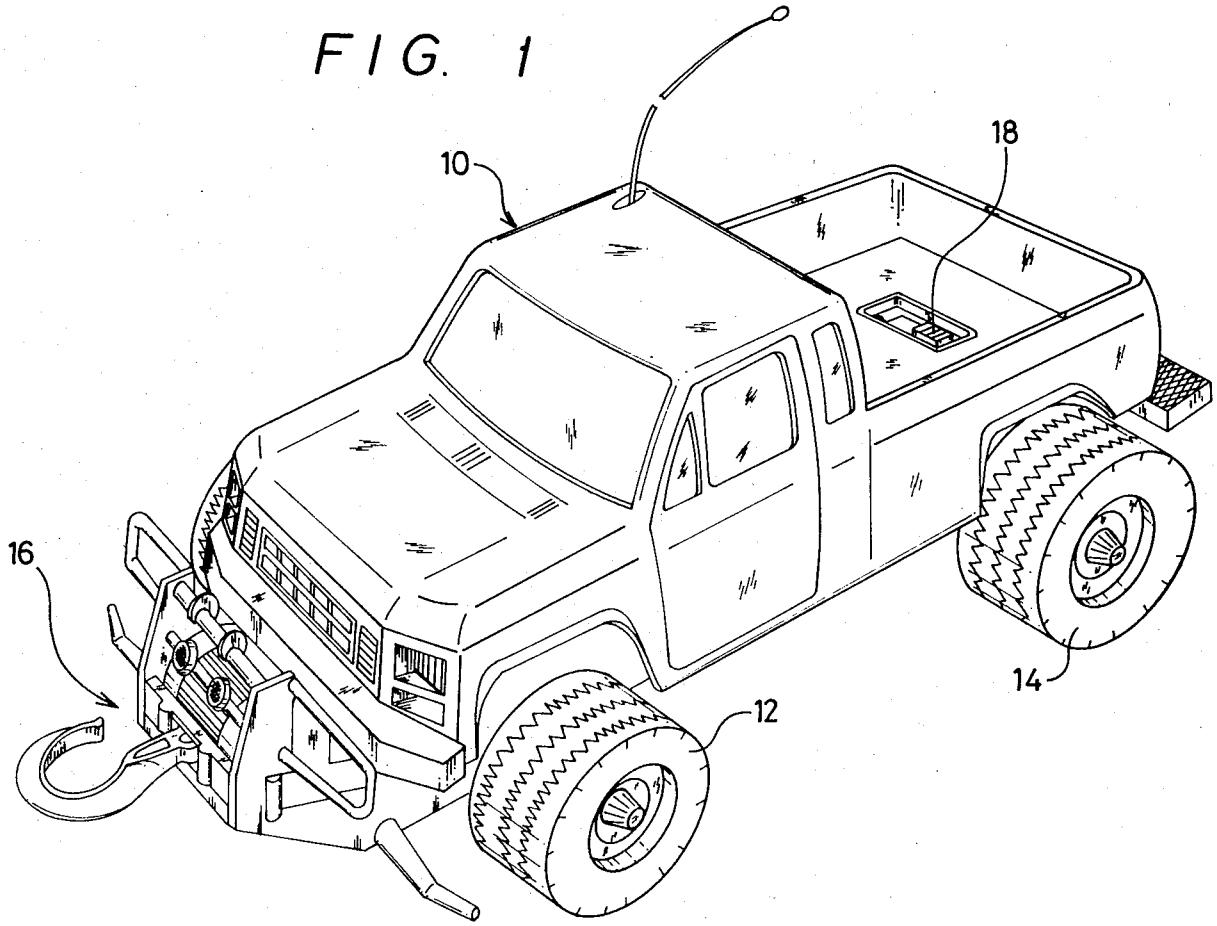
FIG. 1 is a perspective view of one embodiment of a wireless-controllable toy car with a winch mechanism according to the invention.

FIG. 1 shows one embodiment of the wireless-controllable toy car with the winch mechanism according to the invention. Referring to FIG. 1, a car body 10 at its front and rear is provided with respective pairs of driving wheels 12, 14 while a winch mechanism 16 is mounted beneath a front bumper. Furthermore, a rear deck of the car body 10 is provided with a switch 18 for switching the running and the winching operations.

Figure 2:
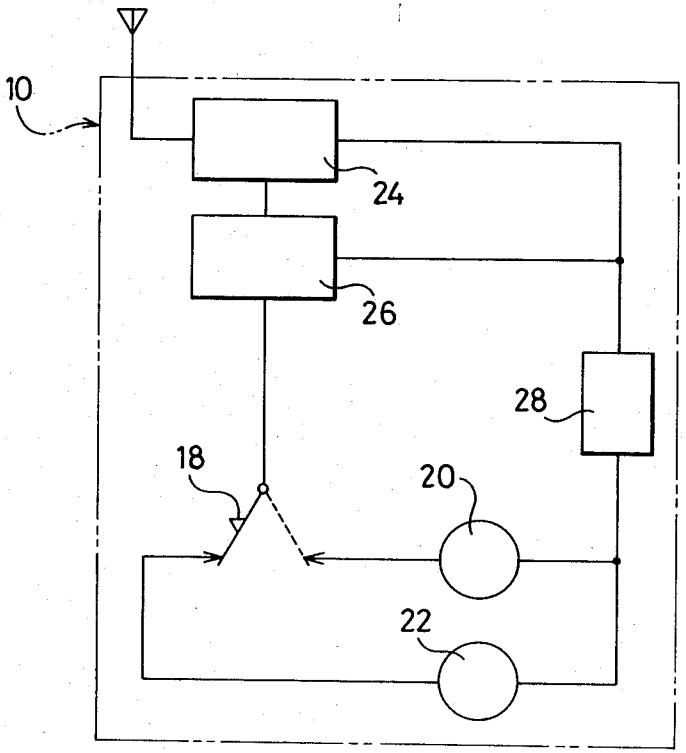
FIG. 2 is a block diagram of a circuit for an electric controlling mechanism according to the invention.

In accordance with the invention, as a means for driving the wheels 12, 14 and the winch mechanism 16, there are provided electric motors 20, 22 which may be independently controlled. A basic construction of an electric controlling circuit for the motors 20, 22 is shown in FIG. 2. As shown in FIG. 2, the motors 20, 22 are connected in parallel to a power circuit comprising a wireless-receiver 24, a motor-driving circuit 26 and a battery 28, thereby to allow the switch 18 to energize either one of the motors 20, 22.

Figure 3:
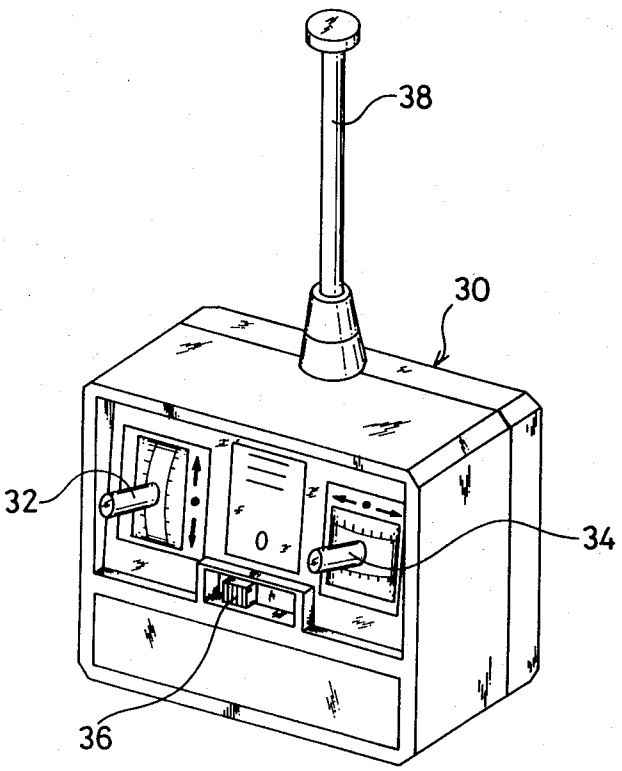
FIG. 3 is a perspective view of a wireless controlling transmitter useful in the invention.

On the other hand, a wireless-transmitter 30 useful in the invention is shown in FIG. 3, which is identical to the conventional one. The transmitter 30 is provided with a lever 32 for controlling rotation of the motor and a lever 34 for controlling a steering operation. The former lever controls normal and reverse rotation of the motor as well as its discontinuation, while the latter lever controls turning to the right or the left as well as the neutral position of the running wheels. In FIG. 3, reference numeral 36 represents a power switch while reference numeral 38 represents a transmitter antenna.

In accordance with the invention, when the switch 18 is switched-over so as to energize the motor 20, the operation of the lever 32 of the transmitter 30 may control the forward and backward running operation of the car as well as its discontinuation, while the lever 34 may control the turning operation to the right or the left of the car as well as its neutral position. When the switch 18 is then switched-over so as to energize the motor 22, the lever 32 may control the winding and unwinding operation of the winch mechanism, as well as its discontinuation.

The winch mechanism 16 according to the invention will now be described with reference to FIG. 4, in which the winch mechanism 16 comprises a winch drum 40, to which is transmitted a given rotary driving force from an output shaft of the electric motor 22 via a reduction gear mechanism. To the winch drum 40 is secured one end of a winch rope 42 having a given length, while the other end of the rope 42 is provided with a hook 44, thereby to allow the rope 42 to be wound or unwound on the winch drum 40. In this embodiment of the winch mechanism 16, the reduction gear mechanism for transmitting the driving force from the output shaft of the motor 22 to the winch drum 40 may be constructed in the following manner. At first, the output shaft of the motor 22 is provided with a first gear 46 which is mounted between a pair of fixed rings 48 and 50 (which in turn are fixed to the output shaft) with a spring 52 and which may idle against the spring 52 under an overload on the winch mechanism, as described hereinafter. The first gear 46 is in mesh with a second large gear 54 having a concentric second small gear 56 which in turn is in mesh with a third large gear 58. The latter gear 58 is concentric with a third small gear 60, a fourth gear 62 and a fifth gear 64 which in turn is in mesh with a sixth gear 68 rotatably supporting a shaft 66 of the winch drum 40. At opposing faces of the sixth gear 68 and the winch drum 40 are provided respective meshing elements 70, 72 which may be coupled in the rotating direction. On the opposite side of the winch drum 40, the shaft 66 supports a seventh large and an eighth small gear 76 in mesh respectively with the third small gear 60 and the fourth gear 62 for stabilizing the latter gears. In this case, a portion of the shaft 66 extended from the sixth gear 68 extends through a spring 78 and is slidable and rotatable in a wall of a housing 80 of the winch mechanism 16, while the opposite end of the shaft 66 protrudes outward sufficiently from the housing 80 and is covered at its end with a cap 82, thereby to allow the sixth gear 68 and the winch drum 40 to be coupled by their meshing elements 70, 72 under the action of spring 78 for transmitting the driving force of the motor 22 to the winch drum 40.

Figure 4:
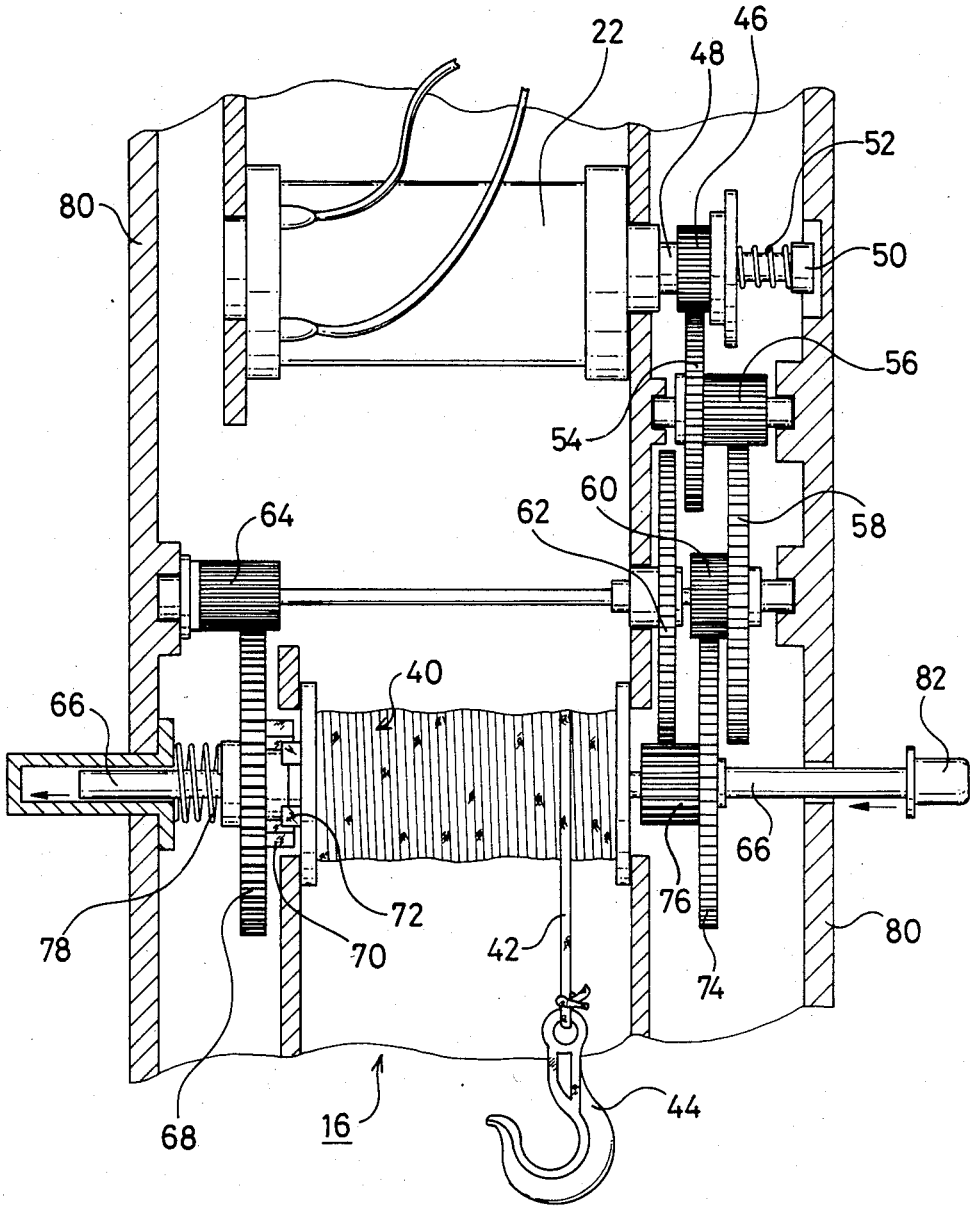
FIG. 4 is a partially sectional plan view of a winch mechanism according to the invention.

In accordance with the winch mechanism 16 thus constructed, the shaft end with the cap 82 is pushed against the spring 78 in the direction shown with an arrow in FIG. 4 to release the coupling of the sixth gear 68 with the winch drum 40 at their meshing elements 70, 72 and thus to permit smoothly withdrawing the winch rope 42 from the drum 40.

The output shaft of the electric motor 22 for the winch mechanism 16 is resiliently engaged with the first gear 46 through the spring 52 arranged between the pair of fixed rings 48, 50 so that these rings may slip or idle relative to the first gear 46 to prevent burning out of the electric motor due to the overload when the winch drum 40 is forcibly stopped.

As described hereinabove, the wireless-controllable toy car with the winch drum according to the invention is provided independently with electric motors for the driving wheels and for the winch mechanism, while a switch is provided for switching the power circuit connected to the electric motors, so that the single combination of the wireless transmitter and receiver may be used to achieve the running and the winching operations conveniently and smoothly.

In particular, in accordance with the invention, a specific independent motor for the winching operation is provided, so that any gear-transmission mechanism for the running operation may be omitted, resulting in a simple and strong construction. Moreover, upon the overload of the electric motor caused by discontinuation of the winding operation, the idling mechanism as a means for preventing the overload may be mounted directly on the output shaft of the electric motor thereby to protect the latter conveniently.

Furthermore, in accordance with the invention, the winch drum is releasably coupled with the reduction gear for transmitting the driving force, so that the winch drum may be disengaged from the reduction gear by an external operation for allowing the free rotation of the winch drum and hence the rapid withdrawal of the winch rope through hand operation.

The winch mechanism according to the invention has been described in connection to a wireless-controllable toy car but is not limited thereto, and may be applied to any conventional remotely-controllable toy car.

Although the invention has been described in connection with preferred embodiments, many variations and modifications may be possible without departing from the spirit and scope of the invention.

What is claimed is:

1. A wireless-controllable toy car with a winch mechanism, comprising driving wheels and a winch mechanism, an electric motor for driving and controlling the wheels, another electric motor for operating the winch mechanism, a single two-position changeover switch for switching a power circuit for the electric motors thereby selectively to actuate one or the other of the electric motors, the electric motor for controlling the operation of the winch mechanism having an output shaft, reduction gearing connecting said output shaft to a winch drum of said winch mechanism, idling means between said output shaft and said reduction gearing for preventing overload of the winch mechanism electric motor upon stopping of the winch drum at the end of a winding cycle of the winch mechanism, said idling means comprising a gear idly mounted on said output shaft between two fixed rings, and resilient means acting against one of said fixed rings and pressing said gear against the other of said fixed rings, the reduction gearing including a winch drum shaft on which said winch drum is supported, a reduction gear fixedly secured to said winch drum shaft, said drum having a face adjacent said reduction gear, meshing elements on said reduction gear and said face that engage with each other in the direction of rotation of the winch drum to drive the winch drum in rotation, the winch drum shaft being mounted for slidable movement axially within the winch drum, and means for sliding the shaft axially to disengage said meshing elements from each other thereby to disengage the reduction gear from the winch drum to permit free withdrawal of a filament wound on the winch drum, and means resiliently urging the winch drum shaft in a direction to engage said meshing elements.

* * * * *